US009180674B2

(12) United States Patent
Cyman, Jr. et al.

(10) Patent No.: US 9,180,674 B2
(45) Date of Patent: Nov. 10, 2015

(54) SYSTEM AND METHOD FOR SUPPLYING INK TO AN INKJET CARTRIDGE

(71) Applicant: R. R. Donnelley & Sons Company, Chicago, IL (US)

(72) Inventors: Theodore F. Cyman, Jr., Grand Island, NY (US); Anthony V. Moscato, North Tonawanda, NY (US); Kent David Jayme, Grand Island, NY (US); George A. Alessi, Tonawanda, NY (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 14/175,598

(22) Filed: Feb. 7, 2014

(65) Prior Publication Data

US 2014/0225964 A1 Aug. 14, 2014

Related U.S. Application Data

(60) Provisional application No. 61/762,735, filed on Feb. 8, 2013.

(51) Int. Cl.
*B41J 2/175* (2006.01)

(52) U.S. Cl.
CPC ..... *B41J 2/17506* (2013.01); *B41J 2/175* (2013.01)

(58) Field of Classification Search
USPC ..... 347/84, 85, 86, 87, 89
See application file for complete search history.

(56) References Cited

U.S. PATENT DOCUMENTS

| | | | | |
|---|---|---|---|---|
| 4,340,896 | A | | 7/1982 | Cruz-Uribe et al. |
| 4,342,042 | A | | 7/1982 | Cruz-Uribe et al. |
| 4,494,124 | A | | 1/1985 | Piatt et al. |
| 4,694,307 | A | | 9/1987 | Toganoh et al. |
| 4,734,711 | A | | 3/1988 | Piatt et al. |
| 4,764,780 | A | | 8/1988 | Yamamori et al. |
| 4,827,278 | A | | 5/1989 | Lecheheb |
| 4,929,963 | A | | 5/1990 | Balazar |
| 5,121,132 | A | | 6/1992 | Pan et al. |
| 5,489,925 | A | | 2/1996 | Brooks et al. |
| 5,537,134 | A | | 7/1996 | Baldwin et al. |
| 5,555,005 | A | | 9/1996 | Pagnon |
| 5,583,544 | A | | 12/1996 | Stamer et al. |
| 5,625,396 | A | | 4/1997 | Keefe et al. |
| 5,683,508 | A | | 11/1997 | Bleiler et al. |
| 5,691,754 | A | | 11/1997 | Ta |
| 5,742,308 | A | | 4/1998 | Cowger et al. |
| 5,745,137 | A | | 4/1998 | Scheffelin et al. |
| 5,745,138 | A | | 4/1998 | Ostermeier |
| 5,757,390 | A | | 5/1998 | Gragg et al. |
| 5,757,406 | A | | 5/1998 | Kaplinsky et al. |
| 5,801,736 | A | * | 9/1998 | Ikkatai et al. ..... 347/86 |
| 5,852,458 | A | | 12/1998 | Scheffelin et al. |
| 5,880,748 | A | | 3/1999 | Childers et al. |
| 5,886,718 | A | | 3/1999 | Johnson et al. |
| 5,963,238 | A | | 10/1999 | Scheffelin et al. |
| 5,966,156 | A | | 10/1999 | Scheffelin et al. |
| 5,992,975 | A | | 11/1999 | Gasvoda et al. |
| 5,992,986 | A | | 11/1999 | Gyotoku et al. |
| 6,003,984 | A | | 12/1999 | Bohorquez et al. |

(Continued)

*Primary Examiner* — Anh T. N. Vo
(74) *Attorney, Agent, or Firm* — McCracken & Gillen

(57) ABSTRACT

In a system and method for operating an ink supply to an inkjet cartridge, wherein the ink supply includes an ink reservoir and an ink tube, ink in the ink reservoir is coupled to ink in the ink tube. Ullage above the ink in the ink reservoir is coupled with ullage above the ink in the ink tube. Ink from the ink tube is supplied to the inkjet cartridge.

25 Claims, 7 Drawing Sheets

(56) References Cited

U.S. PATENT DOCUMENTS

| | | | | |
|---|---|---|---|---|
| 6,012,806 | A | 1/2000 | de Olazabal | |
| 6,030,074 | A | 2/2000 | Barinaga | |
| 6,139,136 | A | 10/2000 | Mackay et al. | |
| 6,145,971 | A | 11/2000 | Baker et al. | |
| 6,161,913 | A | 12/2000 | Childers et al. | |
| 6,164,771 | A | 12/2000 | Eckard et al. | |
| 6,170,937 | B1 | 1/2001 | Childers et al. | |
| 6,183,078 | B1 | 2/2001 | Pietrzyk et al. | |
| 6,188,417 | B1 | 2/2001 | Keefe et al. | |
| 6,196,668 | B1 | 3/2001 | Bode | |
| 6,206,510 | B1 | 3/2001 | Casserino et al. | |
| 6,227,641 | B1 | 5/2001 | Nishikori et al. | |
| 6,273,560 | B1 | 8/2001 | Keefe et al. | |
| 6,281,916 | B1 | 8/2001 | VanSteenkiste | |
| 6,318,850 | B1 | 11/2001 | Childers et al. | |
| 6,341,853 | B1 | 1/2002 | Scheffelin et al. | |
| 6,367,919 | B1 | 4/2002 | Taylor et al. | |
| 6,402,306 | B1 | 6/2002 | Childers et al. | |
| 6,428,156 | B1 | 8/2002 | Waller et al. | |
| 6,450,629 | B2 | 9/2002 | Childers | |
| RE37,874 | E | 10/2002 | Pawlowski, Jr. et al. | |
| 6,464,346 | B2 | 10/2002 | Otis, Jr. et al. | |
| 6,491,365 | B2 * | 12/2002 | Sonobe | 347/22 |
| 6,508,545 | B2 | 1/2003 | Dowell et al. | |
| 6,543,877 | B1 | 4/2003 | Boutet et al. | |
| 6,648,434 | B2 | 11/2003 | Walker et al. | |
| 6,669,327 | B1 | 12/2003 | Harper | |
| 6,679,592 | B2 | 1/2004 | Casserino et al. | |
| 6,698,869 | B2 | 3/2004 | Vosahlo | |
| 6,705,711 | B1 | 3/2004 | Richards | |
| 6,733,115 | B2 | 5/2004 | Santhanam et al. | |
| 6,773,097 | B2 | 8/2004 | Dowell | |
| 6,779,875 | B2 | 8/2004 | Pawlowski, Jr. et al. | |
| 6,840,604 | B2 | 1/2005 | Kimura et al. | |
| 6,883,905 | B2 | 4/2005 | Kimura et al. | |
| 7,004,573 | B2 | 2/2006 | Hewitt | |
| 7,008,050 | B2 | 3/2006 | Childers et al. | |
| 7,025,448 | B2 | 4/2006 | Olsen | |
| 7,033,007 | B2 | 4/2006 | Seethoo | |
| 7,040,729 | B2 | 5/2006 | Richards | |
| 7,097,290 | B2 | 8/2006 | Yoshida | |
| 7,104,637 | B1 | 9/2006 | Van Steenkiste | |
| 7,147,295 | B2 | 12/2006 | Phillips | |
| 7,261,399 | B2 | 8/2007 | Miki | |
| 7,331,664 | B2 | 2/2008 | Langford et al. | |
| 7,401,907 | B2 | 7/2008 | Perez | |
| 7,455,395 | B2 | 11/2008 | Wilson et al. | |
| 8,128,212 | B2 * | 3/2012 | Katada et al. | 347/89 |
| 8,177,344 | B2 * | 5/2012 | Asada | 347/89 |
| 8,186,819 | B2 * | 5/2012 | Kaiho | 347/89 |
| 8,794,747 | B2 * | 8/2014 | Enomoto et al. | 347/85 |
| 2005/0062815 | A1 * | 3/2005 | Yoshihira et al. | 347/89 |
| 2009/0040249 | A1 * | 2/2009 | Wouters et al. | 347/7 |

* cited by examiner

SYSTEM AND METHOD FOR SUPPLYING INK TO AN INKJET CARTRIDGE

CROSS-REFERENCE TO RELATED APPLICATION

The present application claims the benefit of Cyman, Jr. et al., U.S. Provisional Patent Application No. 61/762,735, filed on Feb. 8, 2013, and entitled "System and Method for Supplying Ink to an Inkjet Cartridge." The entire contents of such application are incorporated herein by reference.

BACKGROUND

1. Field of the Disclosure

The present disclosure relates generally to inkjet printing systems and more particularly a system and method for supplying ink to one or more inkjet cartridges used by systems.

2. Description of the Background of the Disclosure

High-speed printing systems typically include one or more imaging units. Each imaging unit has one or more inkjet cartridges and a controller controls each inkjet cartridge to eject a fluid (such as ink or other composition) onto a receiving surface. Each inkjet cartridge includes a nozzle plate that includes a plurality of orifices (nozzles) through which ink from inside the inkjet cartridge may be controllably ejected.

An inkjet cartridge typically includes a fluid chamber and one or more nozzles. Pressure inside of the fluid chamber is increased relative to ambient air pressure to force a drop of fluid through the nozzle(s). Some inkjet cartridges use a piezoelectric element that deforms a wall of the fluid chamber to reduce the volume thereof and thereby increase the pressure within the fluid chamber. Alternately, a heating element may be used to vaporize some of the fluid (or a constituent of the fluid such as a fluid carrier or a solvent) in the fluid chamber to form a bubble therein, which increases the pressure inside the fluid chamber. A controller controls the current that is passed through the piezoelectric element to control the deformation thereof or to control the current through the heating element in turn to control the temperature thereof so that drops are formed when needed. Other types of inkjet technologies known in the art may be used in the printing systems described herein.

In a printing system, an inkjet cartridge may be secured to a carrier and disposed such that the nozzles of the inkjet cartridge are directed toward the receiving surface. The carrier may be manufactured from steel or other alloys that can be milled to a high precision. More than one inkjet cartridge may be secured to a carrier in this fashion in a one or two-dimensional array. Moscato et al., U.S. Provisional Patent Application Ser. No. 61/523,079, filed Aug. 11, 2011, discloses one such apparatus and method for disposing inkjet cartridges in a carrier. Kanfoush et al., U.S. Provisional Patent Application No. 61/535,150 filed Sep. 15, 2011, discloses an apparatus and method for disposing an inkjet cartridge in a mount that may be secured to the carrier. The entire contents of U.S. Provisional Patent Application Nos. 61/523,079 and 61/535,150 are incorporated herein by reference.

Dried ink, dust, paper fibers, and other debris can collect on a nozzle plate or in a nozzle of an inkjet cartridge and prevent proper ejection of ink from the nozzles thereof. The controller of a printing system can undertake periodic cleaning cycles during which ink is purged from the nozzle to release any debris in or near such nozzle. The purged ink and/or debris must be removed from the nozzle plate in the vicinity of the nozzles so that such purged ink and/or debris does not collect thereon and dry to create further debris that will later interfere with ejection of ink from nozzles of the cartridge. Moscato et al., U.S. Provisional Application No. 61/685,002, filed Mar. 9, 2012, discloses a system and method of cleaning inkjet cartridges, the entire contents of which are incorporated herein by reference.

Ink is supplied to each inkjet cartridge from an ink reservoir via an ink line. If air becomes trapped in the ink line and flows into the fluid chamber of the inkjet cartridge during printing, such air may interfere with the proper ejection of ink from the nozzles of the inkjet cartridge.

SUMMARY

According to one aspect of the present disclosure, system for supplying ink to an inkjet cartridge includes an ink reservoir and an ink tube. The ink reservoir and the ink tube each have ink therein and ullage above the ink. A first fluid line couples the ink in the ink reservoir with the ink in the ink tube, and a second fluid line couples the ullage above the ink in the ink reservoir with the ullage above the ink in the ink tube. The system also includes a third fluid line that supplies ink from the ink tube to the inkjet cartridge.

According to another aspect of the present disclosure, a method of operating an ink supply for an inkjet cartridge, wherein the ink supply comprises an ink reservoir and ink tube, each having ink therein and ullage above the ink, includes the step of coupling the ink in the ink reservoir with the ink in the ink tube. The method also includes the steps of coupling the ullage above the ink in the ink reservoir with the ullage above the ink in the ink tube, and supplying ink from the ink tube to the inkjet cartridge.

DETAILED DESCRIPTION OF THE PREFERRED EMBODIMENTS

Figure 1A:
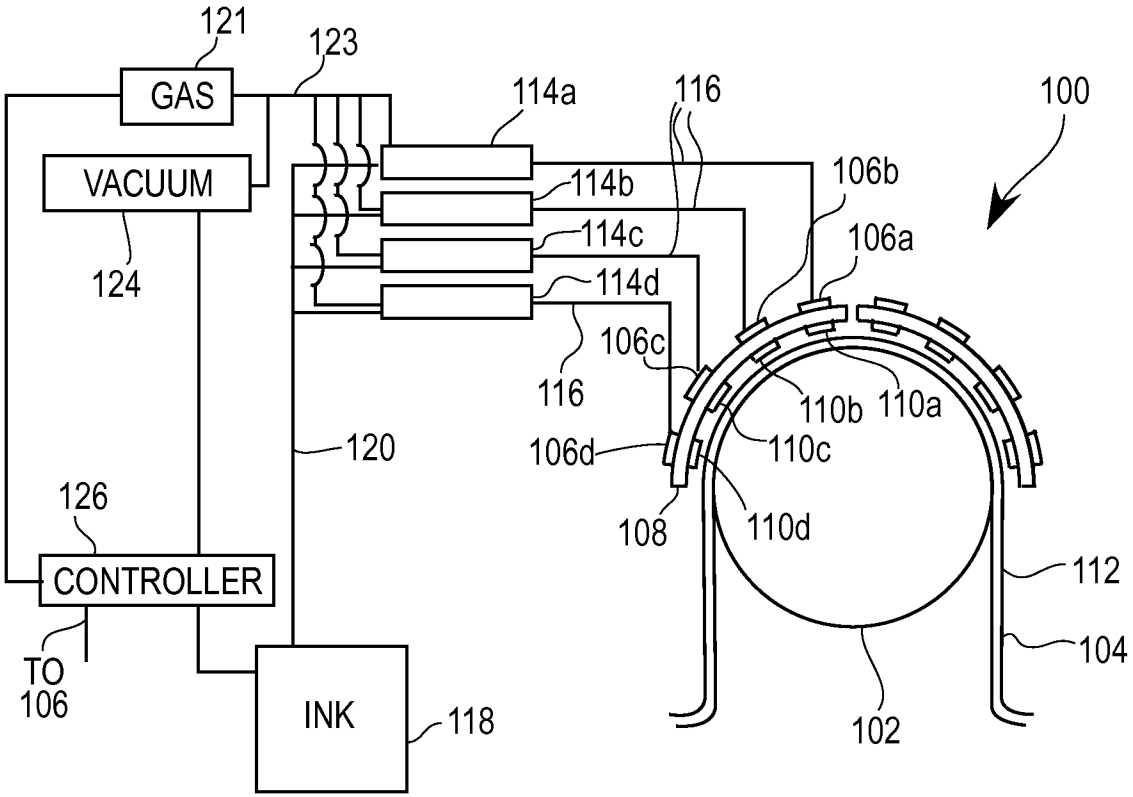
FIGS. 1A and 1B are combined block and schematic representations of an inkjet printing system according to the present disclosure.

Referring to FIG. 1A, a printing system 100 includes a drum 102 about the circumference of which a receiving surface 104 may be transported. The receiving surface 104 may be any medium onto which a material may be deposited by an ink jet cartridge including paper, plastic sheet, fabric, foil, and the like. The printing system 100 also includes inkjet cartridges 106 disposed in a carrier 108 such that nozzle plates 110 of the inkjet cartridges 106 face an outer surface 112 of the receiving surface 104. Ink is supplied to the inkjet cartridges 106 from ink tubes 114 via ink lines 116. A common ink supply 118 supplies ink to all of the ink tubes 114*a*, 114*b*, 114*c*, and 114*d* via a common ink line 120. As described below, a compressed gas (such as air, an inert gas, or nitrogen)

is supplied at a predetermined pressure from a gas source 121 to the ink tubes 114 via a gas line 123 (i.e., a pressure lower than the ambient atmospheric pressure). At other times, a vacuum generator 124 is used to develop a negative pressure in the gas line 123. A controller 126 controls the operation of the printing system 100 and the supply of ink thereto.

Figure 1B:
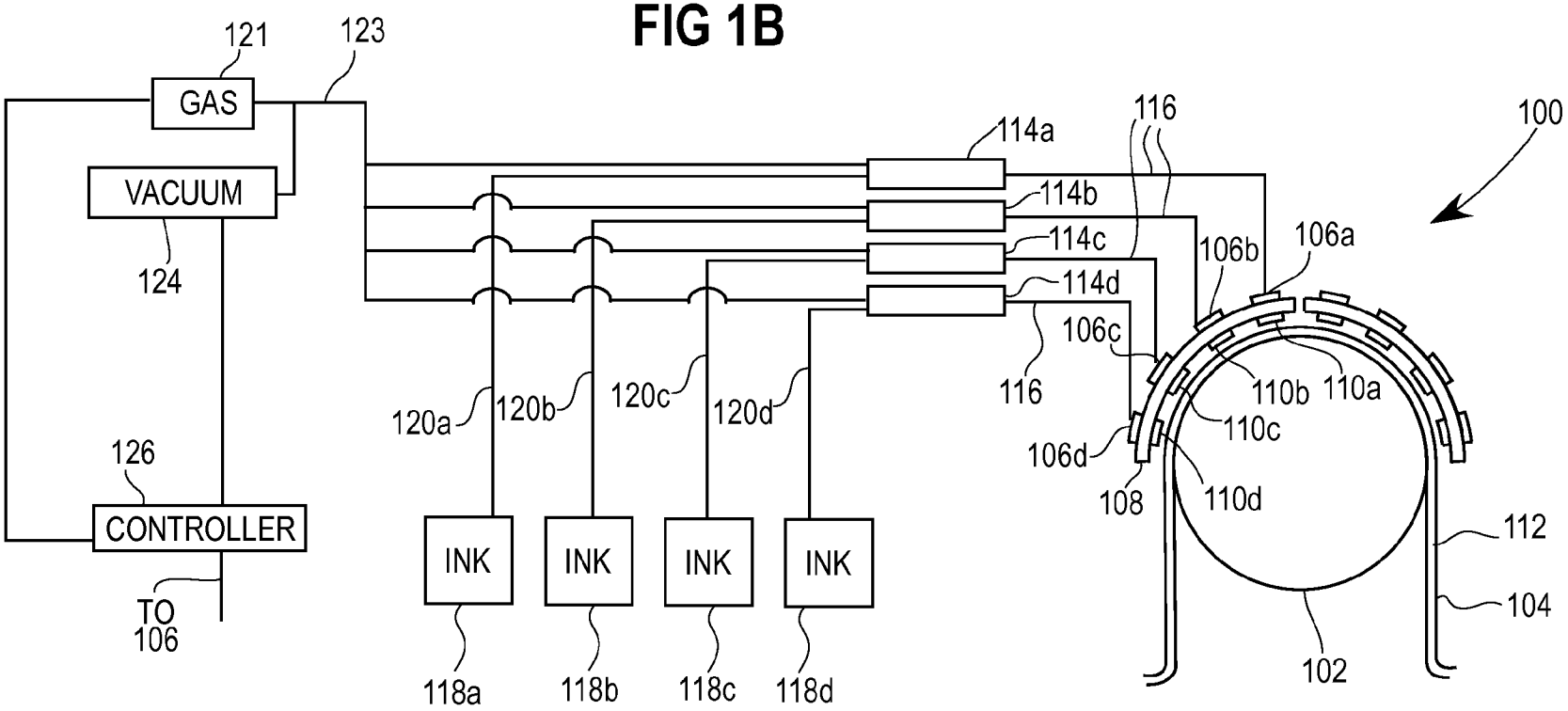

Referring to FIG. 1B, in one embodiment, each ink tube 114*a*, 114*b*, 114*c*, and 114*d* is supplied by a different ink supply 118*a*, 118*b*, 118*c*, and 118*d*, respectively. Therefore, each inkjet cartridge 106*a*, 106*b*, 106*c*, and 106*d* associated with each ink tube 114*a*, 114*b*, 114*c*, and 114*d*, respectively, is supplied with ink from different respective ink supply 118*a*, 118*b*, 118*c*, and 118*d*. For example, each such ink supply 118 may supply a different color of ink. In addition, the vacuum generator 124 may include a separate vacuum regulator associated with each ink tube 114 to provide a negative pressure thereto via a corresponding line 123.

Further, the inkjet cartridges 106 may be distributed radially about the drum 102 so that that the heights of the inkjet cartridges 106*a*, 106*b*, 106*c*, and 106*d* relative to the common ink supply 118 are different. Each ink tube 114*a*, 114*b*, 114*c*, and 114*d* is associated with one inkjet cartridge 106*a*, 106*b*, 106*c*, and 106*d*, respectively. Further, each ink tube 114 is disposed at a predetermined height above the inkjet cartridge 106 associated therewith. In one embodiment, such predetermined height is related to the ambient air pressure where such inkjet cartridge 106 is disposed. For example, at sea level, each ink tube 114 is disposed such that the distance between the ink level in the ink tube 114 and the nozzle plate 110 of the inkjet cartridge 106 associated with such ink tube 114 is approximately 35.5 cm (14 inches). In some embodiments, the distance between a first ink tube 114*a* and the nozzle plate 110*a* of a first inkjet cartridge 106*a* supplied by such ink tube 114*a* may be different than the distance between a second ink tube 114*d* and the nozzle plate 110*d* of a second inkjet cartridge 106*d*. Such difference in distance may be due to, for example, the differences in height between such inkjet cartridges and the common ink supply 118. For example, in one embodiment of the printing system 100, the distance between the ink tube 114*a* and the nozzle plate 110*a* of the inkjet cartridge 106*a* that has the greatest vertical distance from the ink supply 118 may be approximately 43.18 cm (17 inches). In the same printing system 100, the distance between the ink tube 114*d* and the nozzle plate 110*d* of the inkjet cartridge 106*d* that has the least vertical distance from the common ink supply 118 may be approximately 35.5 cm (14 inches).

In some embodiments, the ink tube 114*a* supplies ink to the inkjet cartridge 106*a* and other cartridges disposed in the carrier 108 that are at a height substantially identical to the height of the inkjet cartridge 106*a*. Similarly, the ink tubes 114*b*, 114*c*, and 114*d* supply ink to cartridges disposed in the carrier 108 that are at heights substantially identical to the heights of the inkjet cartridges 106*b*, 106*c*, and 106*d*, respectively.

Typically, the common ink supply 118 supplies ink to a group of ink tubes 114. In some embodiments, one common ink supply 118 supplies ink to all of the inkjet cartridges 106 of a printing system 100 that print the same color of ink. In other embodiments, the common ink supply 118 supplies ink to a first group of the inkjet cartridges 106 and one or more other ink supplies 118 (as shown in FIG. 1B) supply ink to a second group of the inkjet cartridges 106.

Figure 2A:
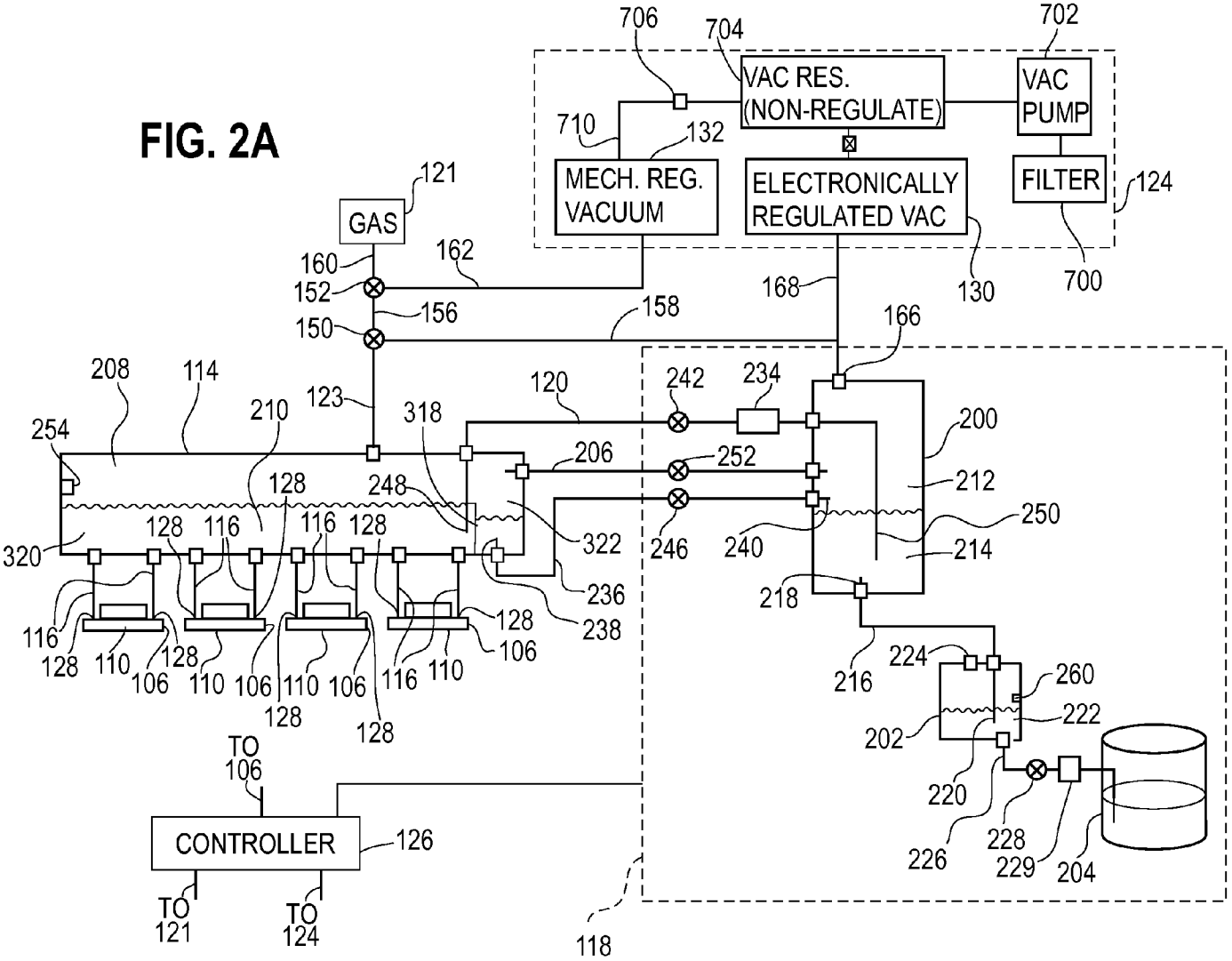
FIG. 2A is a combined block and schematic representation of the inkjet cartridges and an embodiment of an ink supply of the inkjet printing system of FIG. 1.

Referring to FIG. 2A, the inkjet cartridge 106 has one or more input ports 128. For example, some inkjet cartridges have an input port and an output or flush port and such output port can be configured for use as a second input port. In such a cartridge, ink is supplied from the ink tube 114 to each input port 128 via the ink line 116.

The vacuum generator 124 includes an electronic vacuum regulator 130 and a mechanical vacuum regulator 132. Such regulators 130 and 132 regulate a vacuum generated by a common vacuum source (described further below).

During normal operation, the ink tube 114 is maintained at a negative pressure sufficient to prevent ink from inadvertently escaping (or "drooling") from the nozzle plates 110 of the inkjet cartridges 106 supplied by such ink tube 114. To maintain such negative pressure, the controller 126 operates the electronic vacuum regulator 130 and opens a valve 150 to couple the ink tube 114 to a line 158 via line 123. The valve 150 is a multidirectional valve that may be operated to couple the line 123 to either the line 158 or a line 156 that is coupled via a valve 152 and a line 160 to the compressed gas supply 121. In some embodiments, the electronic vacuum regulator 130 is operated to produce in the ink tube 114 a negative pressure in accordance with distance between the ink level in the ink tube 114 and the nozzle plate 110 of the inkjet cartridge 106 supplied by such ink tube 114. For example, if the distance between the level of the ink in ink tube 114 and the nozzle plate 110 of the ink cartridge is 35.5 cm (14 inches), then the vacuum generator 124 produces a pressure equivalent to approximately −35 cm (14 inches) of water. If such distance is 43.18 cm (17 inches), then the vacuum generator produces a pressure equivalent to approximate −43.18 cm (17 inches) of water. The amount of negative pressure in ink tube 114 is predetermined based on average atmospheric pressure in the environment where the printing system 100 is operated and further based on the pressure required to keep ink from inadvertently escaping from the nozzles of the inkjet cartridges 106 of such printing system 100 while at the same time minimizing the energy required to eject a drop of ink from each nozzle. As described above, the vacuum generator 124 may include a different regulator therein for each different amount of negative pressure supplied to the ink tubes 114.

The common ink supply 118 includes a recirculating reservoir 200, an ink supply reservoir 202, and an ink drum 204. The recirculating reservoir 200 supplies ink to the ink tube 114 via the common ink line 120 (although not shown, the ink line 120 is coupled to one or more other ink tubes 114 of the printing system 100). The recirculating reservoir 200 is maintained at a negative pressure identical to that maintained in each ink tube 114 supplied thereby. In particular, a port 166 in the recirculating reservoir 200 is connected to a line 168 and the line 168 is connected to the electronic vacuum regulator 130, which maintains such negative pressure. In some embodiments, a vacuum regulator is operated to adjust the vacuum from the electronic vacuum regulator 130 as necessary to maintain the desired vacuum in the recirculating reservoir 200.

A line 206 couples ullage 208 above ink 210 in ink tube 114 with ullage 212 above ink 214 in the recirculating reservoir 200 to equalize pressure therebetween. Valves 242 and 252, described below, are disposed in the lines 120 and 206. The recirculating reservoir 200 is coupled to the supply reservoir 202 by a line 216. Specifically, one end 218 of the line 216 terminates within the ink 214 in the recirculating reservoir 200. Another end 220 of the line 216 terminates within the ink 222 in the ink supply reservoir 202. The ink supply reservoir 202 includes a port 224 that is open to the atmosphere to maintain the pressure inside the ink supply reservoir 202 at atmospheric pressure.

The ink supply reservoir 202 is coupled to an ink drum 204 by a line 226. During operating of the printing system, a valve 228 is opened and a pump 229 operates to transport ink from the ink drum 204 to the ink supply reservoir 202. If, during operation of the printing system 100, the ink drum 204 is depleted of ink, the ink supply reservoir 202 may be decoupled therefrom by closing the valve 228 and stopping operation of the pump 229. Thereafter, the ink drum 204 may be replaced and the valve 228 opened and operation of the pump 229 resumed. The ink supply reservoir 202 holds a sufficient quantity of ink that operation of the printing system 100 can continue uninterrupted while the ink drum 204 is replaced.

A pump 234 is disposed in fluid communication with the line 120 to transport ink from the recirculating reservoir 200 to the ink tube 114. It should be apparent that additional components such as a degasser, filters, and the like may also be disposed in fluid communication with the line 120 to treat the ink as it is transported to the ink tube 114.

An ink return line 236 is disposed between the ink tube 114 and the recirculating ink reservoir 200. Specifically, one end 238 of the ink return line 236 is disposed within the ink 210 in the ink tube 114. Another end 240 of the ink return line 236 is disposed in the ullage 212 above the ink 214 in the recirculating reservoir 200.

During operation of the printing system 100, the controller 126 generates a negative pressure in the ink tube 114 and the recirculating reservoir 200 as described above and opens the valve 252 in the line 206 to equalize the pressure between the ink tube 114 and the recirculating reservoir 200. In addition, the controller opens the valve 242 in the line 120 and operates the pump 234 to allow ink to flow from the recirculating reservoir 200 to the ink tube 114 via the line 120. The controller also opens a valve 246 to allow ink to flow from the ink tube 114 to the recirculating reservoir 200.

A dam 318 extends fully between inner surfaces of the front and rear of the ink tube 114 and defines regions 320 and 322 thereof. Ink supplied by the line 120 is deposited into the region 320. In addition, ink supplied to the inkjet cartridges 106 is drawn from the region 320. The dam 318 allows ink supplied to the ink tube 114 to pool in the region 320 before overflowing into the region 322. During operation, sufficient ink is supplied to the ink tube 114 that a level of the ink approximately identical to the height of the dam 318 is maintained in the region 320. Any ink beyond such level overflows into the region 322 and is returned to the recirculating reservoir 200 via the line 236. The height of the dam 318 is selected such that sufficient ink is maintained in the region 320 so that sufficient ink is available to purge (as described below) the inkjet cartridge 106 associated with the ink tube 114 and the lines 116 therebetween.

In some embodiments, the dam 318 may include an aperture (not shown) that allows some flow of ink between the regions 320 and 322. Such flow may prevent the ink from stratifying and/or may prevent dissolved components of the ink from precipitating out. The size of the aperture is selected that the flow of ink therethrough is not sufficient to prevent pooling of the ink in the region 320.

Typically, the ink is continuously circulated between the ink tube 114 and the recirculating reservoir 200 during operation of the printing system 100. Further, because the ink return line 236 deposits ink into the ullage 212 in the recirculating reservoir 200, any air in the deposited ink may be released into such ullage 212, from where it may be removed by the vacuum generator 124. In addition, air in the ink 210 may also migrate into the ullage 208 and be removed by the vacuum generator 124 via line 123.

As ink is ejected from the nozzles disposed on the nozzle plate 110, a negative pressure differential is created between the inkjet cartridge 106 relative to the ink tube 114. Such pressure differential causes additional ink to be drawn from the ink tube 114 via the ink line 116 into the inkjet cartridge 106. Such drawing of ink eventually results in a depletion of ink in the recirculating reservoir 200 and additional ink is supplied thereto from the ink supply reservoir 202 because of the pressure difference therebetween.

The ink lines 116 between the ink tube 114 and the inkjet cartridges 106 are oriented substantially vertically. Having the ink lines 116 in a vertical orientation prevents bubbles in the ink that is transported therethrough from entering the inkjet cartridges 106. Instead, any such bubbles migrate upward through the line and into the ink tube 114. Further, as shown in FIG. 2A, the two ends 248 and 250 of the ink line 120 terminate below the levels of the ink 210 and 214, respectively. Disposing the terminations 248 and 250 of the line 120 in this manner minimizes formation of air bubbles in the ink.

Periodically, the ink from the inkjet cartridges 106 may need to be purged and/or the nozzles in the nozzle plates 110 may need to be cleaned. To do so, the controller 126 closes the valve 242 in the line 120, the valve 246 in the line 236, and the valve 252 in the line 206 to decouple the ink tube 114 from the common ink supply 118. Thereafter, the controller 126 operates the valve 152 to couple the line 156 to the line 160 and the valve 150 to couple the line 156 to the line 123. Gas from the compressed gas source 121 is entered into the gas line 123 and thereby into the ink tube 114. The compressed gas in the ink tube 114 increases the pressure therein and causes ink to be forcibly purged through the nozzles in the nozzle plate 110 of the inkjet cartridge 106. In some embodiments the increased pressure is maintained for a predetermined amount time. Typically, the controller repeatedly operates the valve 152 so that ink may be purged in bursts.

After the purging/cleaning cycle is complete, the controller 126 operates the valve 152 to couple the line 162 to the line 156 and operates the mechanical vacuum regulator 132. The pressurized gas from the ink tube 114 is evacuated through the mechanical vacuum regulator 132 without affecting the electronically controlled vacuum supplied to the rest of the system (e.g., the recirculation reservoir 200 or other ink tubes 114 served by the electronic vacuum regulator 130). After a predetermined amount of time passes, the controller closes the valve 152 and operates the valve 150 to couple the line 123 to the line 158 and thereby supply electronically regulated vacuum to the ink tube 114 The controller 126 also opens the valves 242, 246, and 252 to couple the ink tube 114 to the common ink supply 118 via the lines 120 and 206, respectively.

The controller 126 monitors a signal from a sensor 254 in the ink tube 114. If such signal indicates that a level of the ink 210 in the ink tube 114 is higher than a predetermined maximum level, the controller closes the valve 242 and turns off the pump 234 and, if not already open, opens the valve 246 in the ink return line 236 to drain ink from the ink tube 114 into the recirculating reservoir 200. Once the level of the ink 210 in the ink tube 114 reaches a level at or below the predetermined maximum level, the controller opens the valve 242 and restarts the pump 234. In some embodiments, the controller may reduce flow through the pump 234 instead of turning off such pump 234 and closing the valve 242.

Further, in one embodiment, if the signal from the sensor 254 indicates that the level of the ink 210 is below a predetermined minimum level, the controller 126 closes the valve 246 and operates the pump 234 to draw additional ink until the level of the ink 210 is at least at the predetermined minimum level. In another embodiment, if the signal from sensor 254 indicates that the level of the ink 210 is below the predetermined level, the controller 126 generates an error to alert an operator to investigate and correct such situation.

In some embodiments, a sensor 260 is disposed in the ink supply reservoir 202 to monitor the level of the ink 222 therein. If the sensor 260 indicates that the level of the ink 222 in the ink supply reservoir 202 is below a predetermined level, the controller 126 operates (or operates at a higher rate) the pump 229 to draw ink from the ink supply reservoir 202 until the ink 222 reaches at least the predetermined level.

Figure 2B:
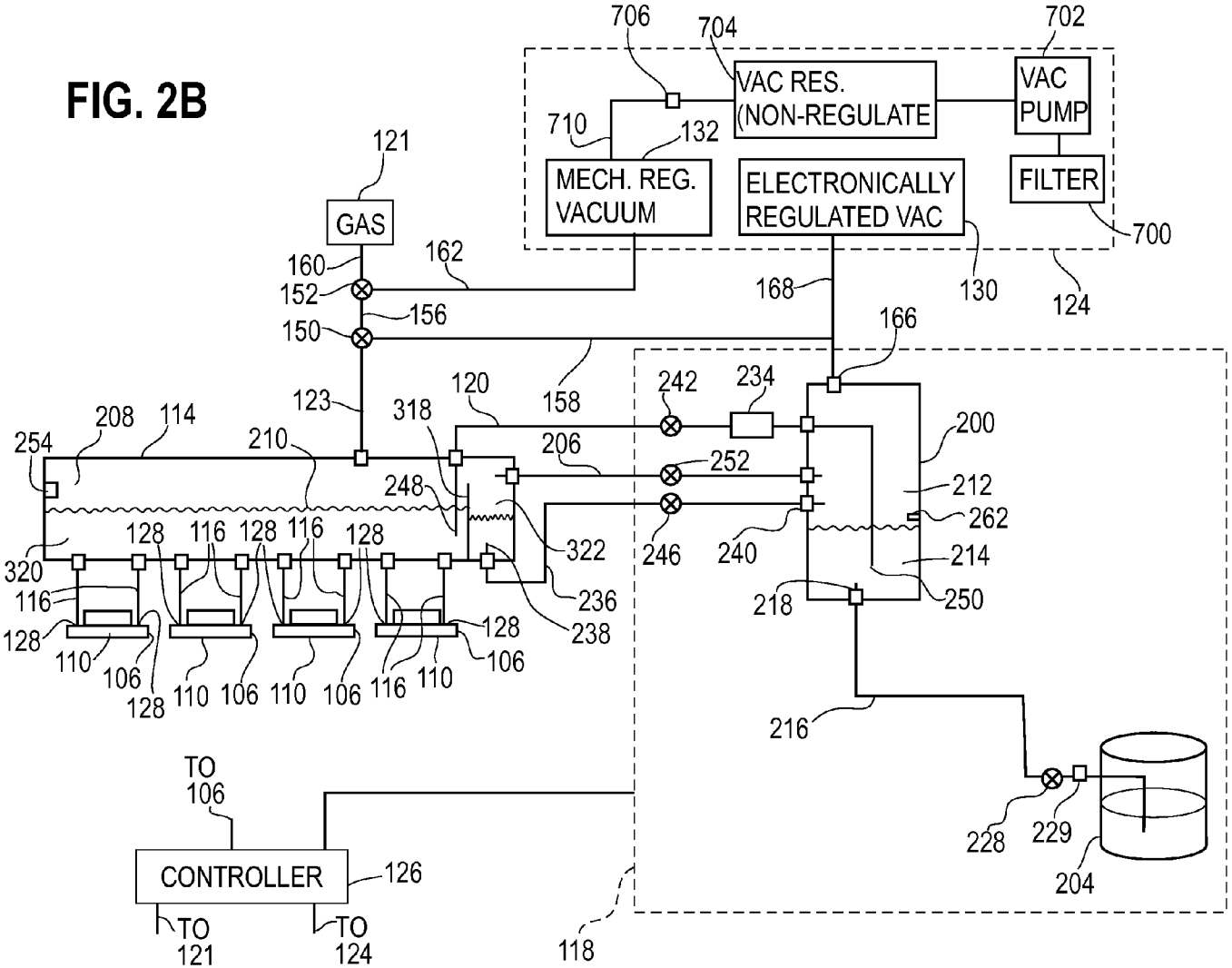
FIG. 2B is a combined block and schematic representation of the inkjet cartridges and another embodiment of an ink supply of the inkjet printing system of FIG. 1.

Referring to FIG. 2B, in some embodiments, ink is supplied to the recirculating reservoir 200 from the ink drum 204 without the intermediary ink supply reservoir 202 described above. In particular, the pump 229 operates to draw ink from the ink drum 204 and supplies such ink, via the valve 228 and the line 216 to the recirculating reservoir 200. In some embodiments, a sensor 262 is disposed in the recirculating reservoir 200 that monitors the level of the ink 214 in the recirculating reservoir 200. If the controller 126 receives a signal from the sensor 262 that the level of the ink 214 is below a predetermined level, the controller 126 operates (or operates at a higher rate) the pump 229 until the signal from the sensor 262 indicates that the level of the ink has reached at least the predetermined level. In other ways, the embodiment of the common ink supply 118 of FIG. 2B operates in a manner that is identical to the embodiment of the common ink supply 118 of FIG. 2A.

Figure 3:
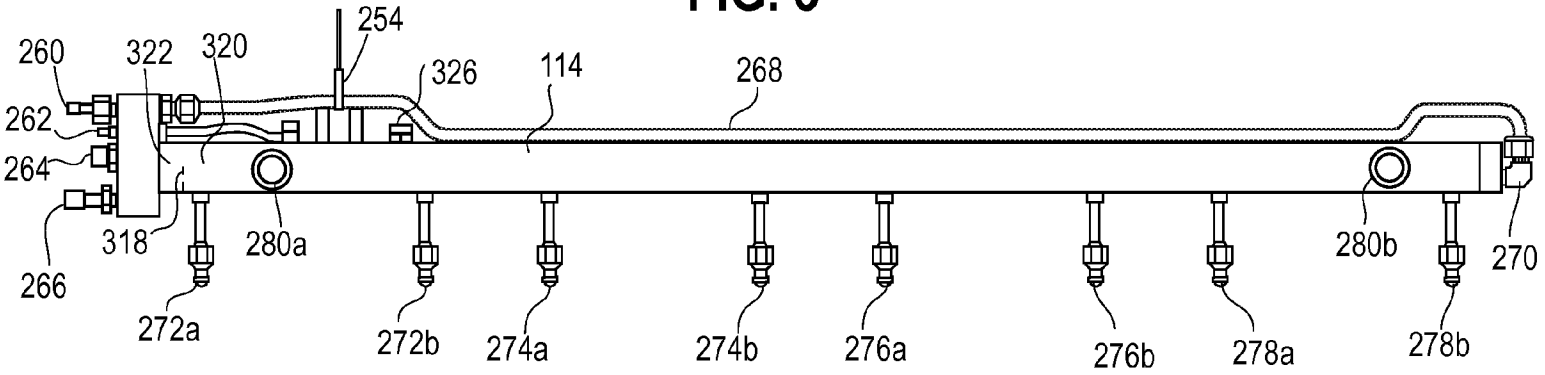
FIGS. 3 and 4 are front elevational views of ink tubes used in the inkjet printing system of FIG. 1.

Referring to FIG. 3, an ink tube 114 includes ports 260, 262, 264, and 266 to connect the ink tube to the lines 120, 206, 123, and 236 respectively. In some embodiments, a line 268 is connected to the port 260 and a port 270 disposed at an end of the ink tube 114 opposite the ports 260-266 through which ink enters the ink tube 114.

The ink tube 114 also includes a pair of ports 272*a* and 272*b* to which ink ports 128 of a first inkjet cartridge 106 are coupled. If the inkjet cartridge 106 has only one ink port, it should be apparent to those having skill in the art that the ink tube 114 would have only one port associated with each cartridge supplied thereby. Similarly, the ink tube 114 includes ports 274, 276, and 278 to connect to the ink ports 128 of second, third, and fourth inkjet cartridges 106.

The ink tube 114 includes sight holes 280*a* and 280*b* that allow an operator to confirm the level of the ink in the ink tube.

The region 320 of the ink tube 114 includes the ports 272, 274, 276, and 278 that provide ink into the lines 116. The region 322 includes the port 266 that provides ink into the ink return line 236 to return ink to the recirculating reservoir 200. Further, the port 270 through which ink from the recirculating reservoir 200 enters the ink tube 114 is disposed in the region 320.

Figure 4:
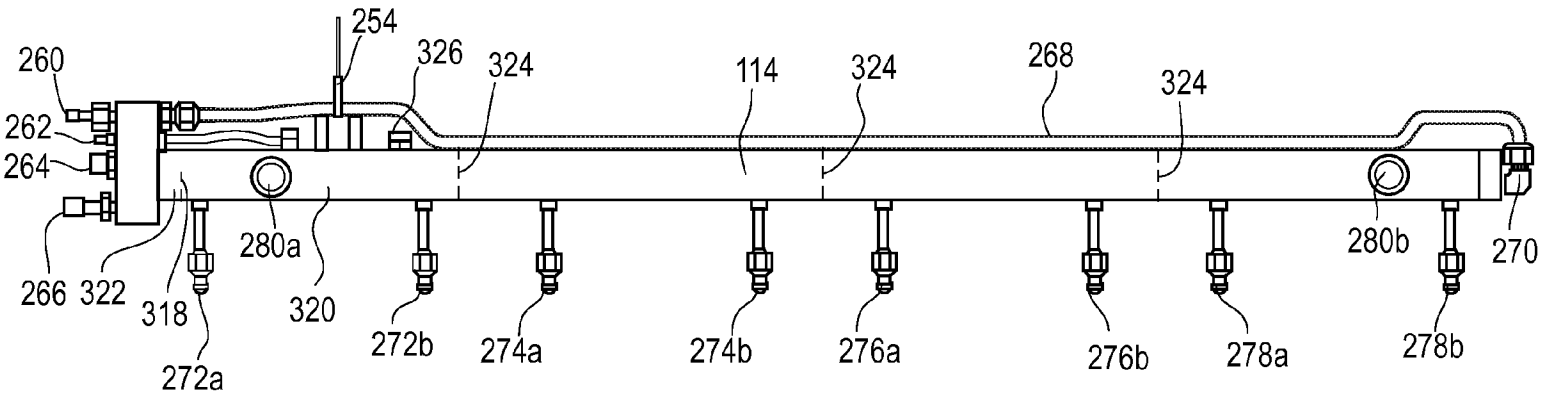

Referring to FIG. 4, some embodiments of the ink tube 114 include a baffle 324 between each set of ports 272, 274, 276, and 278. The baffle 324 may be a screen or an apertured surface. The baffle 324 prevents pressure disturbances from one inkjet cartridge connected to the ink tube 114, for example the cartridge 106*a*, from interfering with the supply of ink to another inkjet cartridge, for example ink cartridge 106*b*, connected to the ink tube 114. The baffle may also reduce turbulence in the ink 210 inside the ink tube 114.

Some embodiments of the ink tube 114 include a pressure release valve 326 that may be operated to release pressure from the ink tube 114. The pressure release valve 326 may be operated by the controller 126 and/or manually by an operator.

During a period of power loss or when the system is shutdown, the valves 242, 246, and 252 are closed to isolate the ink tube 114 from the ink supply 118. Also, the electronic vacuum regulator 130 includes an internal valve that closes when power is lost, thereby locking the vacuum in the recirculating reservoir 200.

Further, a mechanical regulator (not shown) is coupled to the vacuum source 124 and the valve 150 and produces negative pressure in the line 123. The mechanical regulator maintains a sufficient negative pressure in the ink tube 114 to prevent ink from drooling out of the nozzle plate 110 of the inkjet cartridge 106. A valve (not shown) couples a line from the vacuum source 124 to the mechanical regulator that is normally closed and that is opened when the power is lost.

Figure 5:
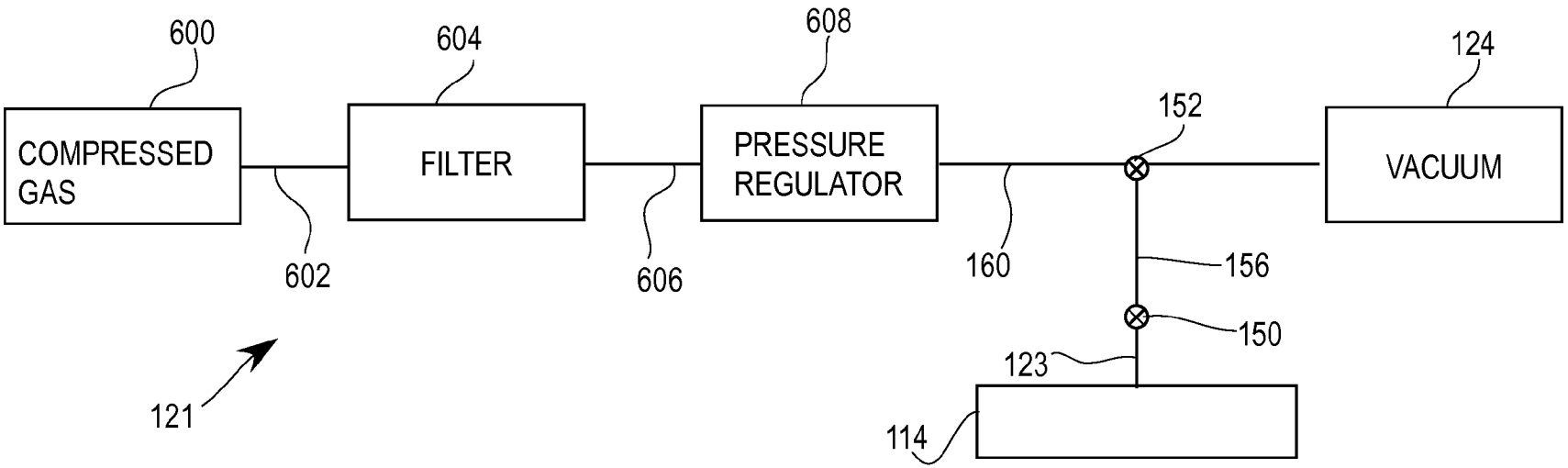
FIG. 5 is a combined block schematic representation of a pressurized gas supply used in the inkjet printing system of FIG. 1.

Referring to FIG. 5, the pressured gas source 121 includes a supply of gas 600 that is pressurized to a level between approximately 15 psi and approximately 100 psi. Such pressurized gas is delivered via a line 602. a filter 604, and a line 606 to a pressure regulator 608. The pressure regulator 608 supplies gas to the line 160 at a pressure of about 10 psi. Other ways of supplying pressurized gas that may be used will be apparent to those of skill in the art.

Figure 6:
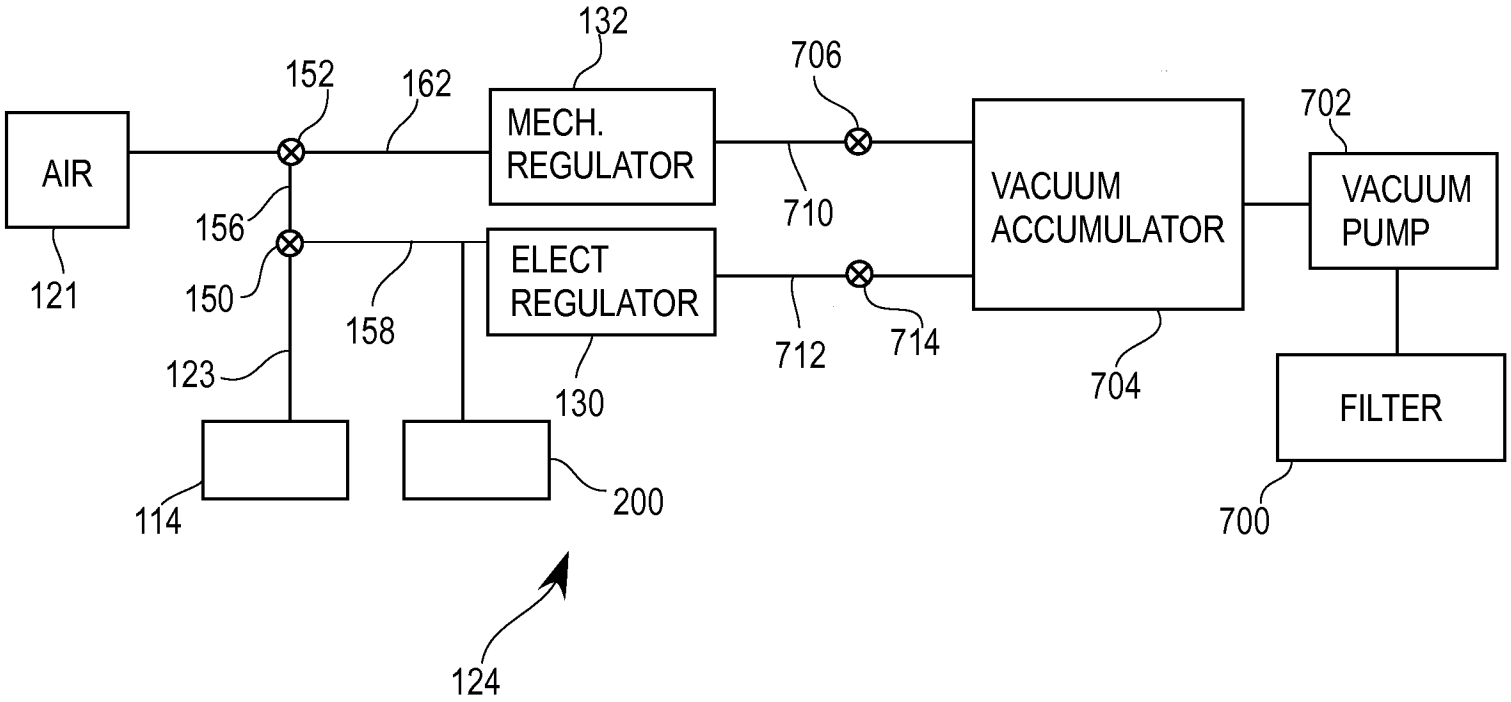
FIG. 6 is a combined block schematic representation of a vacuum generator used in the inkjet printing system of FIG. 1.

Referring to FIG. 6, one embodiment of the vacuum generator 124 includes a filter 700, a vacuum pump 702, and, a vacuum accumulator 704 coupled in series. The vacuum pump 702 draws air from the vacuum accumulator 704 and evacuates the drawn air through the filter 700. The vacuum accumulator 704 provides a maximum vacuum to the mechanical vacuum regulator 132 and the electronic vacuum regulator 130 via lines 710 and 712, respectively. The mechanical vacuum regulator 132 reduces the vacuum provided thereto and supplies such reduced vacuum to the line 162. Similarly, the electronic vacuum regulator 130 reduces the vacuum supplied thereto and supplies such reduced vacuum to the line 158. Valves 706 and 714 are disposed in the lines 710 and 712, respectively, to couple and decouple the vacuum accumulator 704 from the mechanical vacuum regulator 132 and the electronic vacuum regulator 130 when necessary. Other ways of generating a vacuum that may be used will be apparent to those of skill in the art.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the embodiments disclosed herein and to teach the best mode of carrying out same. The exclusive rights to all modifications that come within the scope of the present disclosure are reserved.

We claim:

1. A system for supplying ink to an inkjet cartridge comprising:

an ink reservoir, wherein the ink reservoir has ink therein and ullage above the ink;

an ink tube separate from the ink reservoir, wherein the ink tube has ink therein and ullage above the ink;

a first fluid line that couples the ink in the ink reservoir with the ink in the ink tube;

a second fluid line that couples the ullage above the ink in the ink reservoir with the ullage above the ink in the ink tube;

a third fluid line that supplies ink from the ink tube to the inkjet cartridge; and an ink return line from the ink tube directly connected to the ullage in the ink reservoir.

2. The system of claim 1, further including a fourth fluid line that supplies ink from the ink tube to a further inkjet cartridge.

3. The system of claim 1, further including a further ink tube, wherein the further ink tube has ink therein and ullage above the ink, a fourth fluid line that couples the ink in the further ink tube with the ink in the ink reservoir, and a fifth fluid line that supplies ink from the further ink tube to a further inkjet cartridge.

4. The system of claim 3, further including a sixth fluid line that couples the ullage in the further ink tube with the ullage in the ink reservoir.

5. The system of claim 1, wherein the ink tube comprises a dam therein that separates the ink tube into a first region and a second region, ink from the ink reservoir is deposited via the first fluid line in the first region, and ink in the second region is returned to the ink reservoir via the ink return line.

6. The system of claim 1, wherein if the level of ink in the ink tube exceeds a predetermined threshold, ink from the ink tube is returned to the ink reservoir via the ink return line until the level in the ink tube is at or below the predetermined threshold.

7. The system of claim 1, wherein the ink reservoir is coupled to a source of ink, wherein the source of ink may be decoupled from the ink reservoir without interrupting supply of ink to the inkjet cartridge.

8. The system of claim 1, further comprising a vacuum source that maintains the ink tube at a predetermined negative pressure.

9. The system of claim 8, wherein the vacuum source maintains the ink reservoir at the predetermined negative pressure.

10. The system of claim 8, wherein the amount of negative pressure is controlled in accordance with the atmospheric pressure in the environment where the inkjet cartridge is operated.

11. The system of claim 1, further comprising means for increasing the pressure in the ink tube to force ink into the third fluid line.

12. The system of claim 1, wherein ink continuously circulates between the ink tube and the ink reservoir during operation of the inkjet cartridge.

13. A method of operating an ink supply for an inkjet cartridge, wherein the ink supply comprises an ink reservoir and ink tube separate from the ink reservoir, each having ink therein and ullage above the ink, the method comprises the steps of:

coupling the ink in the ink reservoir with the ink in the ink tube;

coupling the ullage above the ink in the ink reservoir with the ullage above the ink in the ink tube;

supplying ink from the ink tube to the inkjet cartridge; and returning ink from the ink tube to the ink reservoir, wherein the returned ink enters the ullage above the ink in the ink reservoir.

14. The method of claim 13, further including the step of supplying ink from the ink tube to a further inkjet cartridge.

15. The method of claim 13, further including the step of coupling ink in a further ink tube with the ink in the ink reservoir.

16. The method of claim 15, further including the step of coupling the ullage in the further ink tube with the ullage in the ink reservoir.

17. The method of claim 13, further including the step of coupling the ink in the ink tube with the ullage above the ink in the ink reservoir.

18. The method of claim 17, further including the step of returning ink from the ink tube to the ink reservoir until a level of ink in the ink tube is at or below the predetermined threshold.

19. The method of claim 13, further including the step of separating the ink tube into a first region and a second region, depositing ink from the ink reservoir into the first region, and returning ink in the second region to the ink reservoir.

20. The method of claim 13, further including the step of maintaining the ink tube at a predetermined negative pressure.

21. The method of claim 20, further including the step of maintaining the ink reservoir at the predetermined negative pressure.

22. The method of claim 20, wherein the amount of negative pressure is controlled in accordance with the atmospheric pressure in the environment where the inkjet cartridge is operated.

23. The method of claim 13, including the further steps of coupling the ink reservoir to a source of ink, and decoupling the source of ink from the ink reservoir without interrupting supply of ink to the inkjet cartridge.

24. The method of claim 13, including the further step of circulating ink continuously between the ink tube and the ink reservoir during operation of the inkjet cartridge.

25. The method of claim 13, including the further step of increasing the pressure in the ink tube to force ink to the inkjet cartridge.

* * * * *